US005967077A

United States Patent [19]

Shapiro

[11] Patent Number: 5,967,077

[45] Date of Patent: Oct. 19, 1999

[54] ANCHOR KEEPER

[76] Inventor: Jeffrey Bryan Shapiro, 3301 Stoneridge Dr., Birmingham, Ala. 35223

[21] Appl. No.: 09/212,927

[22] Filed: Dec. 16, 1998

[51] Int. Cl.[6] ..... B63B 17/00

[52] U.S. Cl. ..... 114/343; 114/363

[58] Field of Search ..... D12/317; 114/210, 114/221 R, 343, 364, 294, 363

[56] References Cited

U.S. PATENT DOCUMENTS

| | | | |
|---|---|---|---|
| 2,506,893 | 5/1950 | Rogers | 114/210 |
| 3,397,666 | 8/1968 | Gittens | 114/210 |
| 3,771,487 | 11/1973 | McGee, Jr. | 114/210 |

FOREIGN PATENT DOCUMENTS

| | | | |
|---|---|---|---|
| 2824267 | 12/1978 | Germany | 114/210 |

*Primary Examiner*—Ed Swinehart
*Attorney, Agent, or Firm*—Robert J. Veal; Kenneth M. Bush

[57] ABSTRACT

An anchor storage apparatus comprising a cylindrical container having opposing notches formed along the upper rim thereof for receiving opposing ends of the anchor pivot bar therein to support the anchor. The container comprises a hollow tube mounted to the bottom of the container in the center thereof for receiving therein the anchor shank and a portion of the anchor rode and/or chain. The rode is preferably stored in a coiled manner around the hollow tube within the side walls of the container. The bottom of the container has a plurality of drainage holes therethrough to allow water to drain from the container. The bottom of the container is raised relative to the bottom of the side walls to promote water drainage. The side walls of the container have a plurality of holes therethrough to allow air flow so that the rode can adequately dry. An annular ring of soft rubber is affixed along the bottom of the side walls to prevent slippage of the container along the surface of the boat. There is a hole through either the side wall or bottom of the container through which the rode passes for attachment to the boat to prevent loss or substantial displacement of the storage apparatus. The storage apparatus further comprises a cover having a cushion so that the apparatus can be used as a stool.

24 Claims, 3 Drawing Sheets

ANCHOR KEEPER

FIELD OF THE INVENTION

The present invention relates to boat anchors, and more particularly, the present invention relates to a storage system for boat anchors.

BACKGROUND OF THE INVENTION

A boat anchor for smaller vessels is typically a heavy object attached to the vessel by a rope, or "rode", which can be cast overboard to keep the vessel in place by either its weight or its flukes, which grip the bottom of the waterway. On larger vessels, anchors are usually attached to a pulley system that allows the anchor to be conveniently lowered or raised. On these larger vessels, there is typically a large rode locker for storing the anchor rode. On smaller vessels, however, there is typically no dedicated storage for an anchor and rode, and if present, the storage area is usually inadequate.

In certain circumstances, it may become necessary to rapidly deploy an anchor to prevent any number of maritime mishaps. The key to rapid anchor deployment is a state of anchor readiness. When there is no adequate storage, anchor deployment can become frustrated, such as when the anchor rode becomes entangled. An entangled rode can lead to or exacerbate a dangerous situation, such as where the anchor cannot be quickly deployed to prevent the boat from moving into another vessel. Further, when there is no dedicated storage, the anchor and rode are typically stored on the boat deck. As the boat sways, the anchor has a tendency to slide or bounce along the boat surface, which can mar the surface and fracture the protective coating over the surface material (e.g. fiberglass or wood).

What is needed is an improved anchor storage system, particularly adapted for smaller vessels, which is designed for adequate, convenient storage and rapid deployment of the anchor and rode.

SUMMARY OF THE PRESENT INVENTION

It is an object of the present invention to provide an anchor storage apparatus which provides for convenient storage of the anchor and rode.

It is another object of the present invention to provide an anchor storage apparatus which provides for secured storage of the anchor so that it will not mar or damage the boat surface.

It is another object of the present invention to provide an anchor storage apparatus which provides for storage of the rode so that it will not become entangled.

It is another object of the present invention to provide an anchor storage apparatus which provides for rapid deployment of the anchor.

It is another object of the present invention to provide an anchor storage apparatus which minimizes the space required for storage of the anchor and rode.

These and other objects of the present invention are accomplished through an anchor storage apparatus comprising a cylindrical container having opposing notches formed along the upper rim thereof for receiving opposing ends of the anchor pivot bar therein to support the anchor. The container comprises a hollow tube mounted to the bottom of the container in the center thereof for receiving therein the anchor shank and a portion of the anchor rode and/or chain. The rode is preferably stored in a coiled manner around the hollow tube within the side walls of the container. The bottom of the container has a plurality of drainage holes therethrough to allow water to drain from the container. The bottom of the container is raised relative to the bottom of the side walls to promote water drainage. The side walls of the container have a plurality of holes therethrough to allow air flow so that the rode can adequately dry. An annular ring of soft rubber is affixed along the bottom of the side walls to prevent slippage of the container along the surface of the boat. There is a hole through either the side wall or bottom of the container through which the rode passes for attachment to the boat to prevent loss or substantial displacement of the storage apparatus. The storage apparatus further comprises a cover having a cushion so that the apparatus can be used as a stool.

These and other objects and advantages of the invention will become apparent from the following detailed description of the preferred embodiment of the invention.

BRIEF DESCRIPTION OF THE DRAWINGS

An apparatus embodying features of the invention is described in the accompanying drawings which form a portion of this disclosure and wherein.

DETAILED DESCRIPTION OF THE PREFERRED EMBODIMENT

Figure 1:
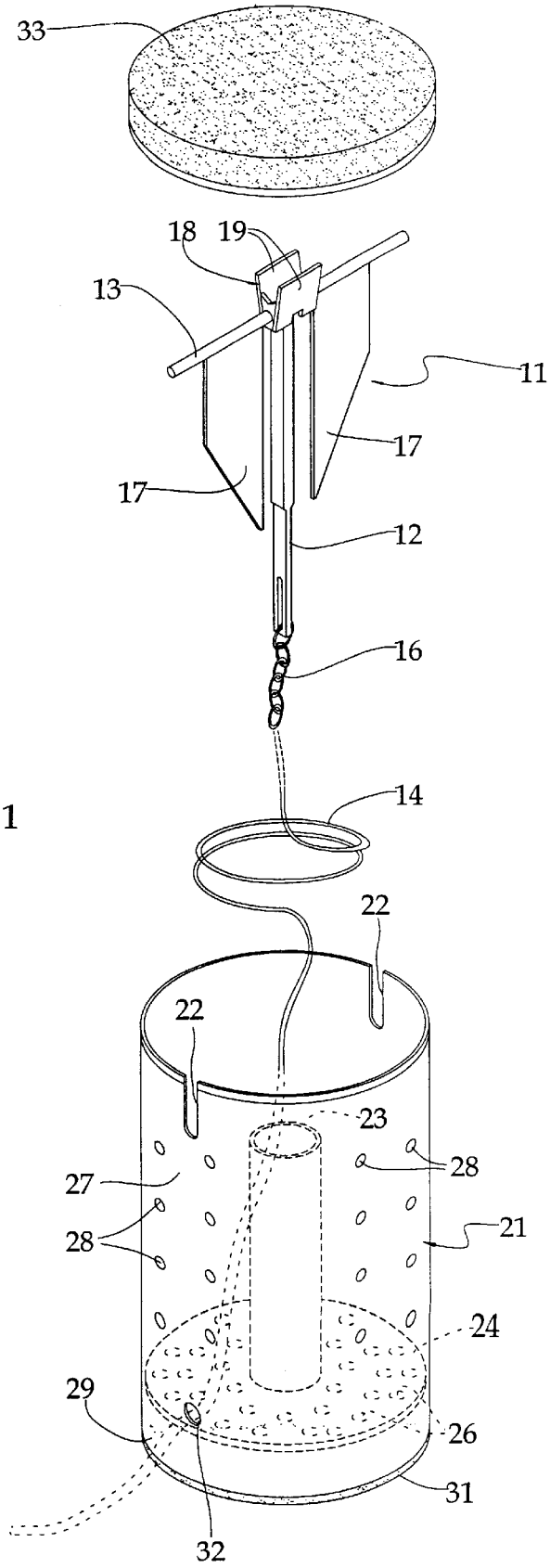
FIG. 1 is an exploded perspective view of the present invention with anchor and rode.

The present invention is particularly adapted for Danforth-type anchors, such as the anchor 11 depicted in the accompanying FIGURES. This type of anchor 11 comprises a shank 12 having a pivot bar 13 pivotally attached at one end and a rope 14, or "rode", attached at the opposite end. Commonly, a short chain 16 connects shank 12 to rode 14. The opposite end of rode 14 is attached to the vessel (not shown). Pivot bar 13 has a pair of flukes 17 and a crown 18 mounted thereon for rotation therewith. Crown 18 comprises a pair of extensions 19 which engage the bottom of the waterway to rotate pivot bar 13 and flukes 17 which, in turn, penetrate the bottom to secure the vessel.

Figure 2:
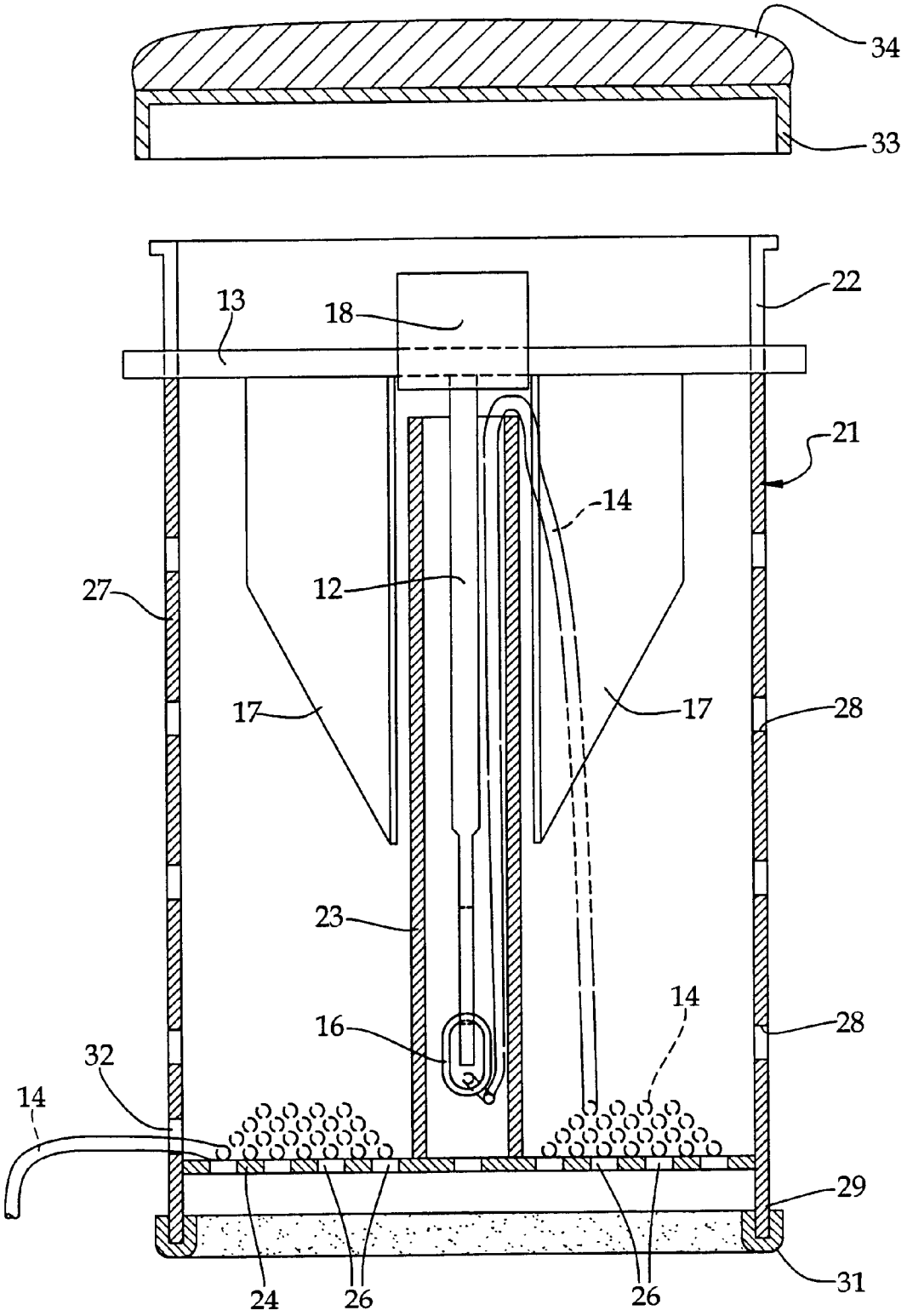
FIG. 2 is side sectional view of the present invention with anchor and rode stored therein.
Figure 3:
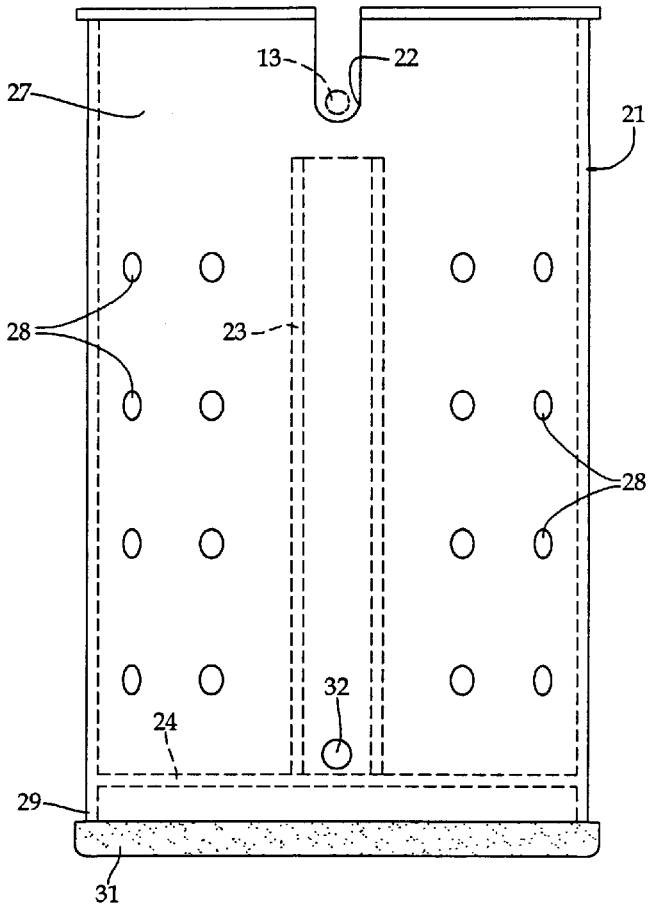
FIG. 3 is side plan view of the present invention.
Figure 4:
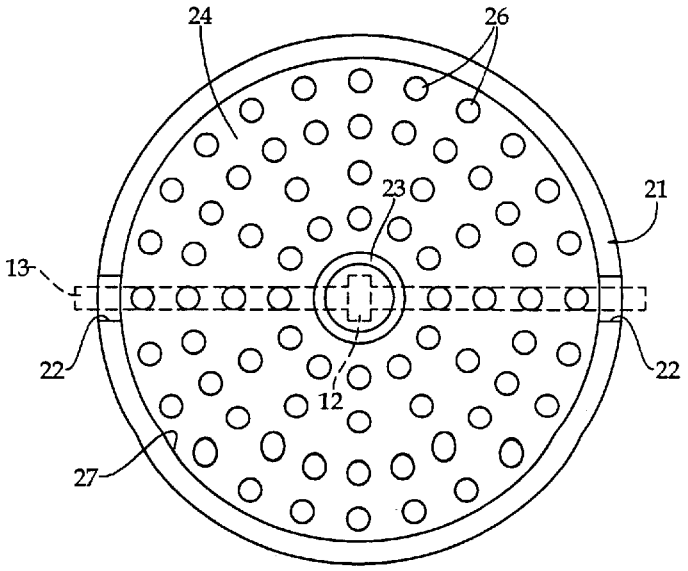
FIG. 4 is top plan view of the present invention.

The present invention, illustrated in FIGS. 1–4, preferably comprises a cylindrical container 21 having opposing notches 22 formed along the upper periphery thereof. Although illustrated herein as cylindrical, container 21 can have any practical shape, such as cross-sectionally square, hexagonal, octagonal, etc. Container 21 further comprises a hollow tube 23 mounted to the bottom 24 of container 21 in the center thereof to receive therein shank 12 and a portion of rode 14 and/or chain 16. Bottom 24 preferably has a plurality of drainage holes 26 therethrough to allow water to drain from container 21 so anchor 11 and rode 14 will not be subject to the deterioration associated with prolonged exposure to water. Additionally, the side margins 27 of container 21 preferably have a plurality of holes 28 therethrough to allow air flow so that anchor 11 and rode 14 can adequately dry. Further, bottom 24 of container 21 is preferably raised relative to the bottom 29 of margins 27 to promote water drainage. A resilient material 31, such as rubber, is attached along bottom 29 of margins 27 to prevent slippage of container 21 along the surface of the boat. Container 21 has a hole 32 through either side margin 27 or bottom 24 through which rode 14 passes for attachment to the boat to prevent loss or substantial displacement of the storage apparatus. The storage apparatus further comprises a cover 33 having a cushion 34 mounted thereon so that the apparatus can be used as a stool.

The storage apparatus allows for convenient storage of the rode and anchor. During retrieval, rode 14 is simply coiled around hollow tube 23, which prevents the rode from becoming entangled. Once rode 14 has been collected, shank 12 of anchor 11 and a portion of rode 14 and/or chain 16 are inserted into tube 23 and opposing ends of pivot bar 13 are inserted into notches 22 to support the anchor. Once the anchor has been properly stowed, lid 33 can be placed on container 21. To deploy the anchor, lid 33 is simply removed and anchor 11 can be manually removed from container 21 and deployed or, in the alternative, container 21 can be inverted such that anchor 11 and rode 14 drop into the water. The rode typically uncoils without any entanglement as the anchor sinks to the bottom of the waterway. Once sufficient rode is out, rode 14 can be placed within one of notches 22 and lid 33 can be placed back on container 21.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. An apparatus for storing an anchor and rode, comprising in combination:

a) a container having first and second ends wherein said first end is open;

b) at least two notches formed along a periphery of said container at said first end thereof for supporting the anchor in said container; and c) a hollow tube affixed within said container for receiving an anchor shank therein, wherein said tube comprises first and second ends with said second end of said tube affixed to a central portion of said second end of said container.

2. An apparatus according to claim 1 wherein said container has an aperture therethrough through which the rode is disposed for attachment to a boat.

3. An apparatus according to claim 1 wherein said second end of said container comprises a plurality of apertures therethrough for water drainage.

4. An apparatus according to claim 1 wherein side walls of said container comprise a plurality of apertures therethrough for air flow.

5. An apparatus according to claim 1, farther comprising means for covering said open first end of said container.

6. An apparatus according to claim 5 wherein said covering means comprises a cushion.

7. An apparatus according to claim 1 wherein said container comprises a circular cross-section.

8. An apparatus according to claim 1 wherein said container comprises a square cross-section.

9. An apparatus according to claim 1 wherein said container comprises a hexagonal cross-section.

10. An apparatus for storing an anchor and rode, comprising:

a) a housing having an open first end for receiving the anchor and rode, wherein said housing comprises means formed along a periphery of said housing at said first end thereof for supporting opposing ends of an anchor pivot bar; and b) means formed within said housing at a second end thereof for receiving an anchor shank therein, wherein said receiving means comprises first and second ends with said second end of said receiving means affixed to a central portion of said second end of said housing.

11. An apparatus according to claim 10 wherein said supporting means comprises at least one pair of opposing notches formed in said periphery of said housing at said first end thereof.

12. An apparatus according to claim 11 wherein said housing has an aperture therethrough through which the rode is disposed for attachment to a boat.

13. An apparatus according to claim 11 wherein side walls of said housing comprise a plurality of apertures therethrough for air flow.

14. An apparatus according to claim 11 wherein said second end of said housing comprises a plurality of apertures therethrough for water drainage.

15. An apparatus according to claim 11, further comprising means for covering said open first end of said housing.

16. An apparatus for storing an anchor and rode, comprising:

a) a cylindrical container having an open first end, opposing notches formed along a periphery of said open first end for supporting the anchor in said container, and an opening through which the rode is disposed for attachment to a boat; and b) a hollow tube mounted to a second end of said container in the center thereof for receiving therein an anchor shank, wherein the anchor rode is stored in a coiled manner around said hollow tube within said container.

17. An apparatus according to claim 16 wherein said second end of said container comprises a plurality of apertures therethrough for water drainage.

18. An apparatus according to claim 17 wherein side walls of said container extend beyond said second end of said container to promote water drainage through said apertures.

19. An apparatus according to claim 18, further comprising resilient means affixed along a second end of said side walls to prevent slippage of said container along a surface of the boat.

20. An apparatus for storing an anchor and rode, comprising in combination:

a) a container having upper and lower ends wherein said upper end is open; and b) a hollow tube affixed within said container for receiving an anchor shank therein, wherein said tube comprises upper and lower ends with said lower end of said tube affixed to a central portion of said lower end of said container such that the anchor rode can be stored in a coiled manner around said hollow tube within said container.

21. An apparatus according to claim 20, further comprising means for covering said open upper end of said container, wherein said covering means comprises a cushion.

22. An apparatus according to claim 21 wherein said lower end of said container comprises a plurality of apertures therethrough for water drainage.

23. An apparatus according to claim 22 wherein side walls of said container extend below said lower end of said container to promote water drainage through said apertures.

24. An apparatus according to claim 23, further comprising resilient means affixed along a lower end of said side walls to prevent slippage of said container along a surface of a boat.

* * * * *